US007070733B2

(12) United States Patent
Kroeker et al.

(10) Patent No.: US 7,070,733 B2
(45) Date of Patent: Jul. 4, 2006

(54) COOLING SYSTEM FOR A TRUNNION RING AND METALLURGICAL FURNACE VESSEL

(75) Inventors: H.-Rudi Kroeker, Fonthill (CA); Wayne Duncan, Fonthill (CA)

(73) Assignee: Whiting Equipment Canada Inc., Ontario (CA)

( * ) Notice: Subject to any disclaimer, the term of this patent is extended or adjusted under 35 U.S.C. 154(b) by 0 days.

(21) Appl. No.: 10/644,661

(22) Filed: Aug. 19, 2003

(65) Prior Publication Data

US 2004/0217525 A1 Nov. 4, 2004

(51) Int. Cl.
*C21B 7/16* (2006.01)
*C21C 1/00* (2006.01)

(52) U.S. Cl. ..... 266/241; 266/244; 266/246

(58) Field of Classification Search ..... 266/241, 266/244, 245, 246, 247, 248
See application file for complete search history.

(56) References Cited

U.S. PATENT DOCUMENTS

| | | | | |
|---|---|---|---|---|
| 3,163,695 A | | 12/1964 | Bumberger | |
| 3,976,223 A | | 8/1976 | Jass et al. | |
| 4,085,924 A | | 4/1978 | Fisher et al. | |
| 4,128,232 A | | 12/1978 | Nagati | |
| 4,676,487 A | * | 6/1987 | Kudinov et al. | 266/194 |
| 4,679,774 A | | 7/1987 | Lawrence et al. | |
| 4,903,640 A | | 2/1990 | Howard | |
| 4,938,456 A | | 7/1990 | Richards | |
| 5,143,683 A | * | 9/1992 | Glassman et al. | 266/246 |
| 5,611,990 A | | 3/1997 | Langlitz et al. | |
| 5,853,656 A | | 12/1998 | Besterman et al. | |

FOREIGN PATENT DOCUMENTS

| | | | | |
|---|---|---|---|---|
| CA | 1106869 | | 8/1981 | |
| CA | 2294949 | | 1/1999 | |
| EP | 0025604 | | 12/1980 | |
| EP | 0837144 | | 4/1998 | |
| EP | 0905466 | | 3/1999 | |
| JP | 51147408 | | 12/1976 | |
| JP | 361174311 A | * | 8/1986 | 266/246 |
| WO | 2004/000651 | | 4/2004 | |

OTHER PUBLICATIONS

Staudinger et al, Design Aspects of an Ideal Oxygen Steelmaking Converter, Jan. 2004, www.AISITECH.org, pp. 45-51.*

* cited by examiner

*Primary Examiner*—Scott Kastler
(74) *Attorney, Agent, or Firm*—Townsend and Townsend and Crew LLP

(57) ABSTRACT

A cooling system for a basic oxygen furnace or an Argon Oxygen Decarburization converter having a metallurgical converter vessel supported in a trunnion ring. The cooling system comprises a number of cooling panels. The cooling panels are mounted or attached to the exterior surface of the trunnion ring and positioned between the outside surface of the vessel and the trunnion ring. A coolant liquid or vapour is pumped or circulated through the cooling panels. The cooling panels are detachable from the trunnion ring for replacement and/or repair without requiring disassembly of the trunnion ring or the metallurgical converter vessel.

9 Claims, 5 Drawing Sheets

COOLING SYSTEM FOR A TRUNNION RING AND METALLURGICAL FURNACE VESSEL

FIELD OF THE INVENTION

The present invention relates to metallurgical vessels with trunnion or carrying rings, and more particularly to a cooling jacket which is detachably coupled to the trunnion ring.

BACKGROUND OF THE INVENTION

Argon oxygen decarburization converters are a type of metallurgical converter which are used in high grade steel and stainless steel refining. These vessels are carried in non-attached trunnion rings. Due to the thermal loads placed on such vessels, these converters are typically lined with a refractory lining or layer having a high magnesia content. The refractory lining serves to absorb the thermal load to reduce the thermal stresses on the vessel, and thereby prolong the service life of the vessel. The thermal loads also affect the trunnion ring even though the ring is arranged at a distance of 100 to 200 mm from the converter vessel.

In the art, various approaches have been taken to reduce the effects of the thermal loads and stresses on the converter vessel and/or the trunnion ring. Known approaches include attaching a cooling system directly to the vessel; running cooling fluid through the interior cavities of the trunnion ring; and incorporating a fluid or a vapour based cooling system into the interior of the trunnion ring.

While known systems have addressed the problems of thermal loading and stressing, there are shortcomings associated with the prior approaches. Accordingly, there still remains a need for an improved cooling mechanism suitable for metallurgical converters utilizing a trunnion or carrying ring.

BRIEF SUMMARY OF THE INVENTION

The present invention provides a cooling system for metallurgical vessels held in a trunnion or carrying ring.

In one aspect, the cooling system comprises a cooling mechanism, the cooling mechanism is detachably coupled to the trunnion ring. The cooling mechanism comprises an arrangement of conduits for circulating a coolant. The conduits may be arranged in one or more panels. The panels, in turn, may be detachably coupled to the trunnion ring.

In a first aspect, the present invention provides a cooling system for an oxygen based metallurgical converter having a vessel supported in a trunnion ring, the trunnion ring having an interior surface and a portion of the vessel being in a spaced relationship from the interior surface of the trunnion ring, the cooling system comprises: (a) one or more cooling panels; (b) each of the cooling panels includes a bracket for coupling the cooling panel to the trunnion ring, the cooling panels are mounted to the surface of the trunnion ring and are positioned adjacent the vessel; (c) each of the cooling panels has an inlet for receiving a coolant, and an outlet for outputting the coolant; and (d) the inlet of each of the cooling panels is coupled to a coolant supply, and the outlet of each of the cooling panels provides a drain outlet for the coolant.

In a further aspect, the present invention comprises an oxygen based metallurgical converter comprising: (a) a converter vessel; (b) a trunnion ring for carrying the vessel; (c) a drive mechanism coupled to the trunnion ring and is operable for tilting the converter vessel; (d) a plurality of cooling panels, each of the cooling panels has a mounting bracket for coupling the cooling panels to the trunnion ring, the cooling panels are located between the trunnion ring and the vessel; (e) each of the cooling panels has an inlet for receiving a coolant; and (f) the inlet of each of the cooling panels is coupled to a coolant supply, and the outlet of each of the cooling panels provides a drain outlet for the coolant.

In another aspect, the present invention provides an argon oxygen decarburization furnace comprising: (a) a converter vessel; (b) a trunnion ring for carrying the vessel; (c) a drive mechanism coupled to the trunnion ring and is operable for tilting the converter vessel; (d) a plurality of cooling panels, each of the cooling panels has a mounting bracket for coupling the cooling panels to the trunnion ring, the cooling panels are located between the trunnion ring and the vessel; (e) each of the cooling panels has an inlet for receiving a coolant, and an outlet for outputting the coolant; and (f) the inlet of each of the cooling panels is coupled to a coolant supply, and the outlet of each of the cooling panels provides a drain outlet for the coolant.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

Reference is next made to the accompanying drawings which show, by way of example, embodiments of the present invention and in which.

DETAILED DESCRIPTION OF EMBODIMENTS OF THE INVENTION

Figure 1:
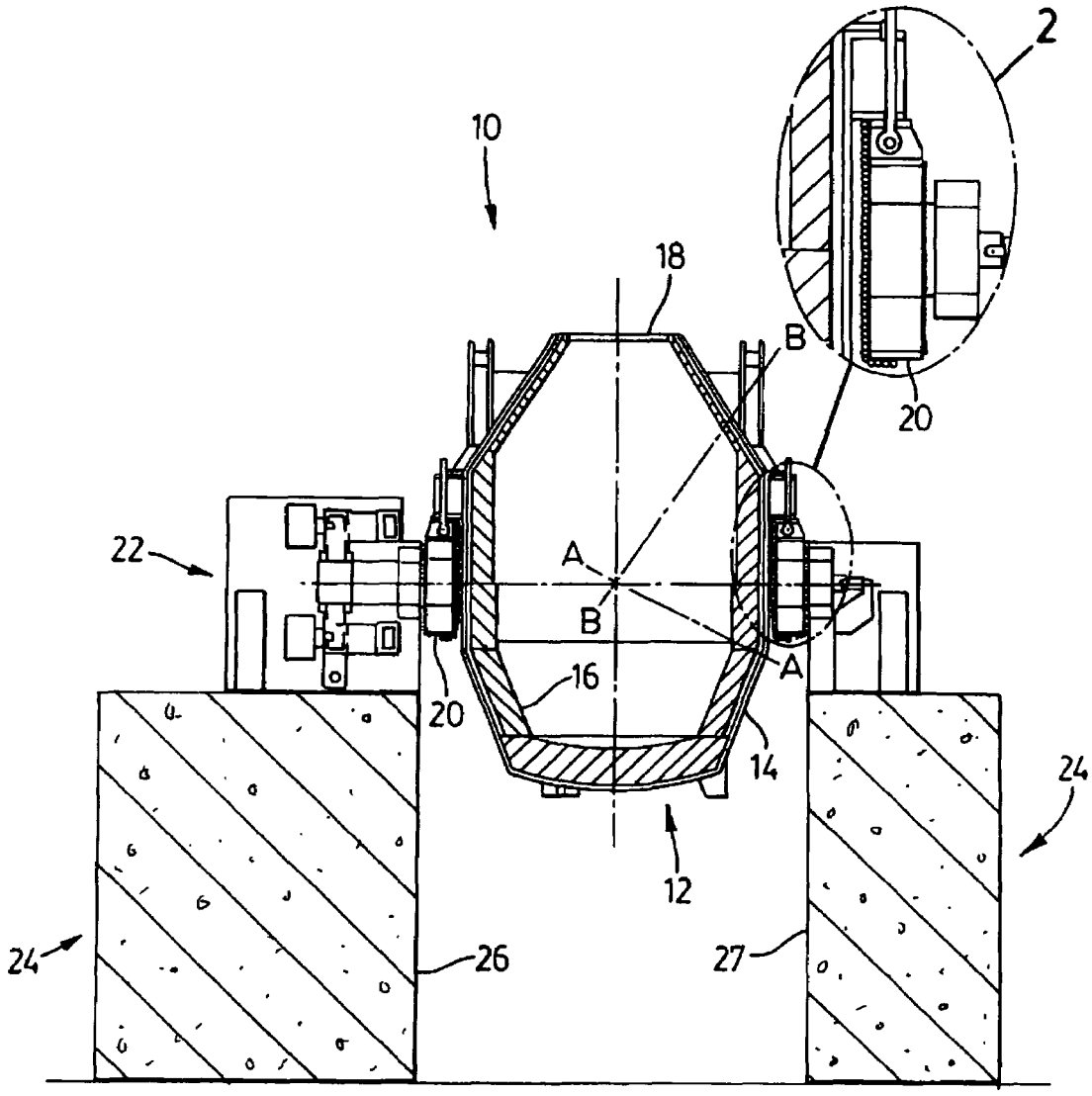
FIG. 1 is a front elevational view of a vessel for a metallurgical converter incorporating a cooling system assembly in accordance with the present invention.

Reference is first made to FIG. 1 which shows a metallurgical converter incorporating a cooling assembly according to the present invention. The metallurgical converter is indicated generally by reference 10, and the cooling assembly is indicated generally by reference 100. In the figures, like references indicate like elements.

The metallurgical converter 10 for purposes of the present description comprises a basic oxygen furnace or BOF of the type typically used in the steel refinery process. It will however be understood that the cooling assembly 100 is applicable to other types of furnaces, including Argon Oxygen Decarburization Converters.

As shown in FIG. 1, the basic oxygen furnace 10 comprises a vessel 12 which is mounted or held by a trunnion ring 20. The vessel 12 comprises a metallic shell 14 and includes a refractory lining 16. The vessel 12 has an opening 18 at its upper end for receiving a metallurgical charge and oxygen charges. The trunnion ring 20 is coupled to a drive or tilt mechanism indicated generally by reference 22. As shown, the drive mechanism 22 and the furnace 10 are mounted on a support structure 24. The support structure 24 comprises a pair of pedestals or supports indicated individually by references 26 and 27. The supports 26, 27 keep the furnace 10 above the refinery floor and allow the drive mechanism 22 to tilt or tip the vessel 12 for receiving a metallurgical charge and emptying the molten steel into a ladle carried on a car, trolley, or crane, emptying the slag into a slag pot carried on a car.

Figure 2:
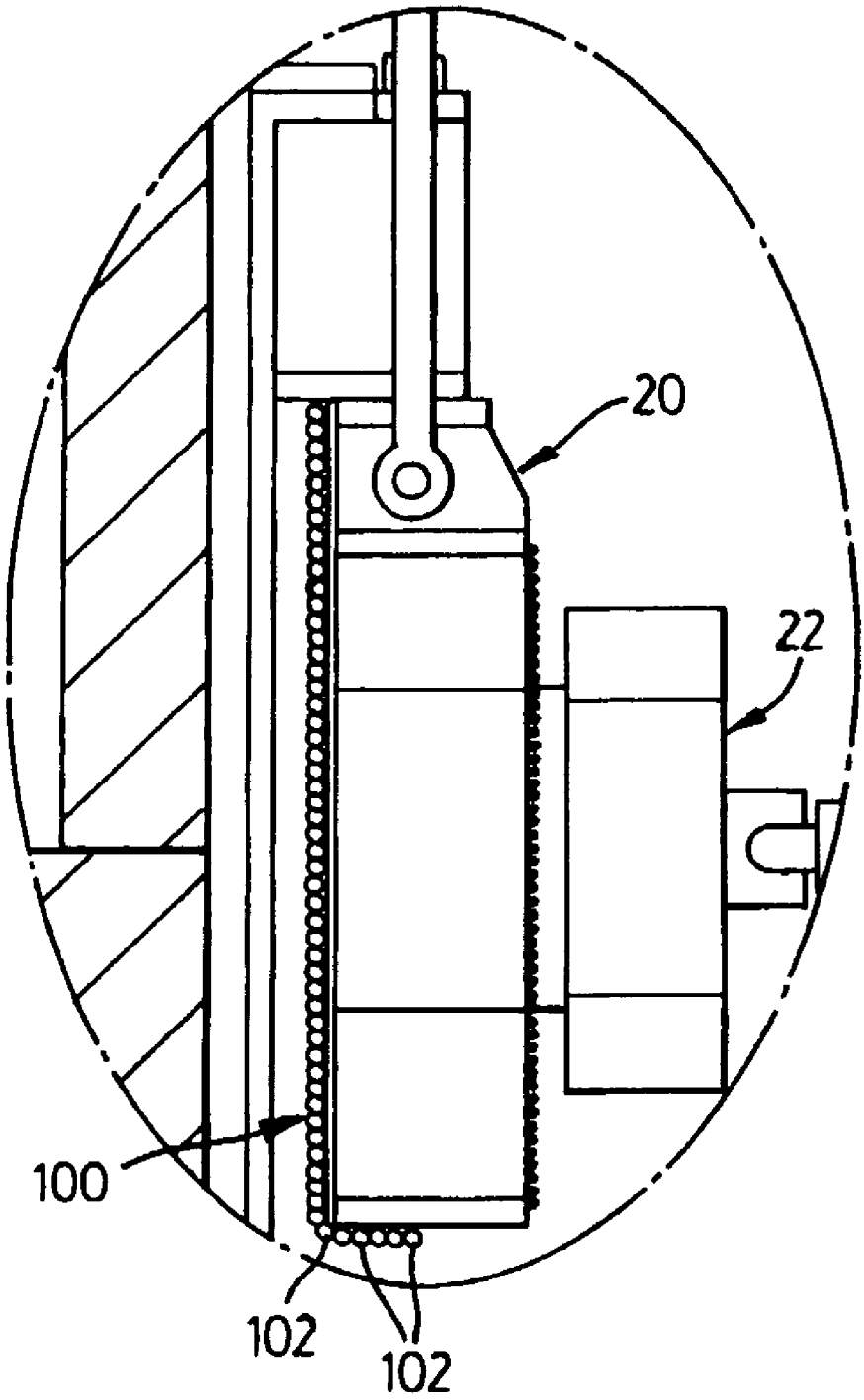
FIG. 2 is an enlarged view of a portion of the cooling system and the vessel of FIG. 1.
Figure 3:
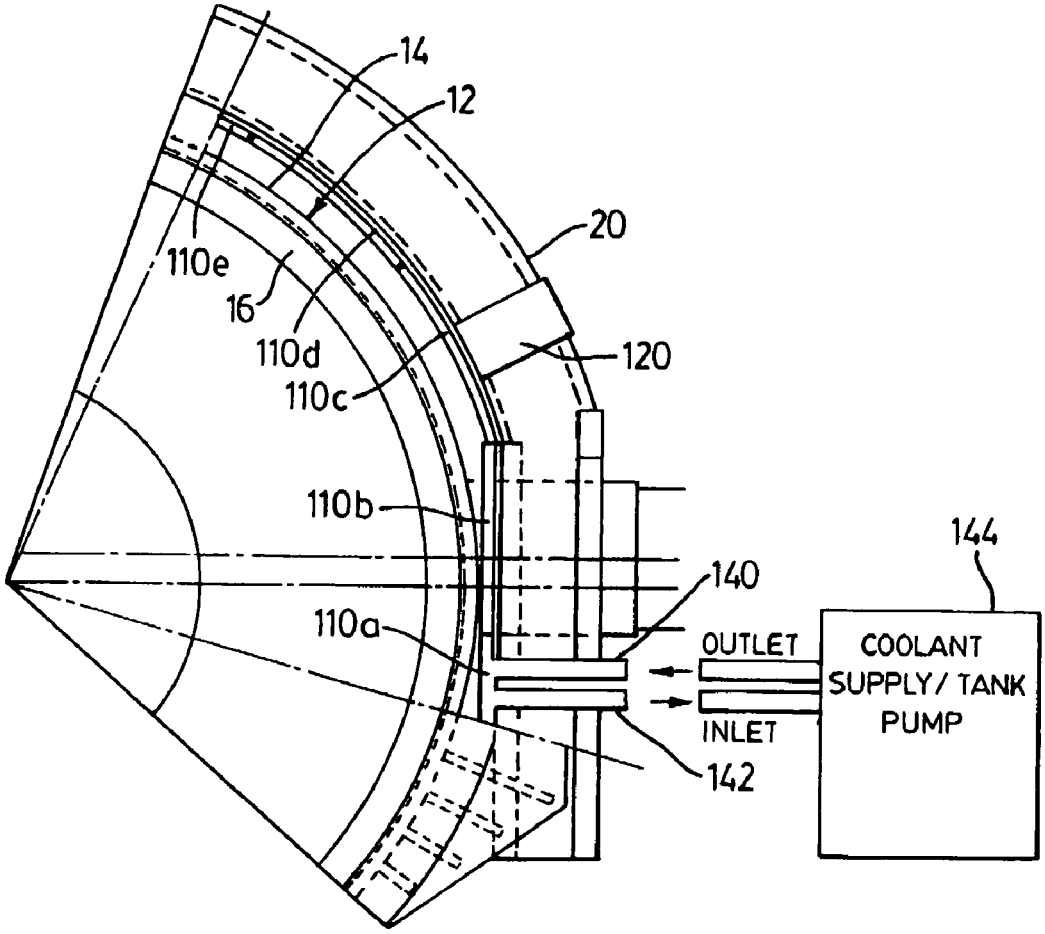
FIG. 3 is a plan sectional view of the vessel and cooling assembly taken along line A—A and line B—B of FIG. 1.

As will now be described in greater detail, the cooling assembly 100 is coupled to the inside surface of the trunnion ring 20, i.e. the surface adjacent the vessel 12. As shown in FIG. 2, the cooling assembly 100 comprises a series of conduits or pipes 102. The pipes or conduits 102 may be arranged as panels 110 as shown in FIG. 3, and indicated individually by references 110*a*, 110*b*, 110*c*, 110*d* and 110*e*. It will be appreciated that the panels 110 are mounted along the surface of the trunnion ring 20 to maximize cooling between the trunnion ring 20 and the vessel 12. The cooling panels 110 serve to absorb and dissipate the thermal load from the exterior surface of the vessel 12. In addition, the cooling panels 110 serve to cool the trunnion ring 20 thereby prolonging its operating life.

Figure 6:
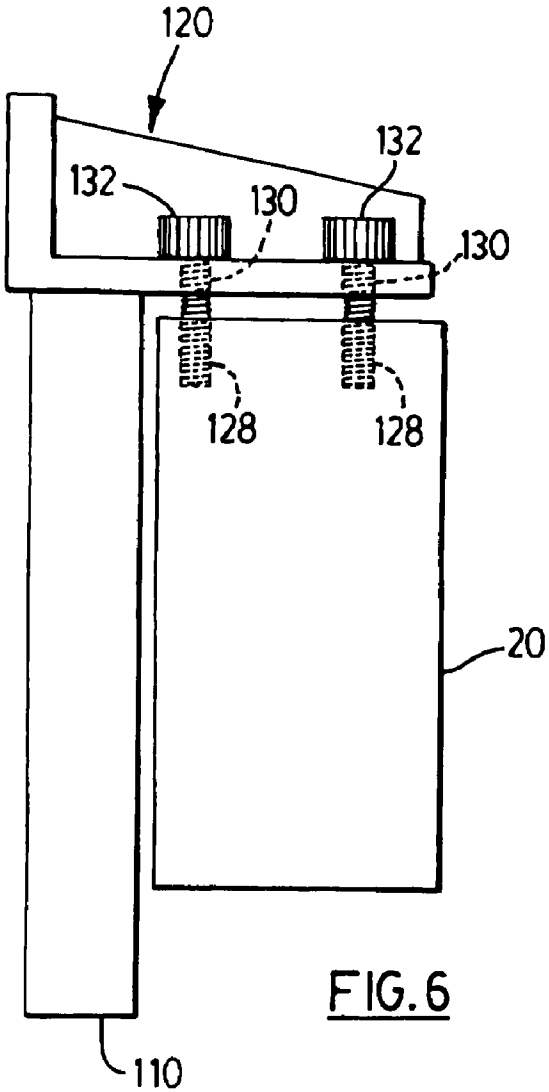
FIG. 6 is a side sectional partial view showing the vessel, the trunnion ring and another mounting bracket for the cooling assembly.
Figure 5:
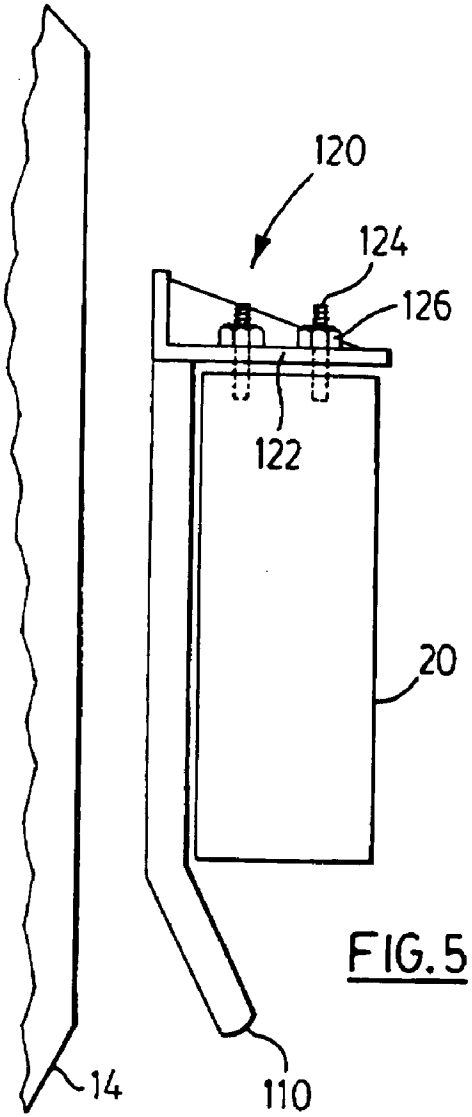
FIG. 5 is a side sectional partial view showing the vessel, the trunnion ring and a mounting bracket for the cooling assembly.

To allow replacement, the cooling pipes 102 or cooling panels 110 are detachably mounted to the trunnion ring 20. The cooling pipes 102 or cooling panels 110 may be mounted using conventional fasteners, such as threaded bolts and screws, clips, hooks or the like. The cooling panels 110 may also include a mounting bracket 120 as depicted in FIG. 5. The mounting bracket 120 rests or engages the surface of the trunnion ring 20. To provide a rigid connection, the mounting bracket 120 may include apertures 122 which register with threaded studs 124. The threaded studs 124 are affixed to the trunnion ring 20 and the cooling panel 110 is secured to the trunnion ring 20 by tightening a nut or other type of threaded fastener 126 on the studs 124. In another embodiment as shown in FIG. 6, the trunnion ring 20 includes threaded sockets 128 which register with apertures 130 in the mounting bracket 120. The mounting bracket 120 and the cooling panel 110 are coupled to the trunnion ring 20 by inserting a bolt 132 through each aperture and tightening the bolt 132 in the corresponding threaded socket 128.

Figure 4:
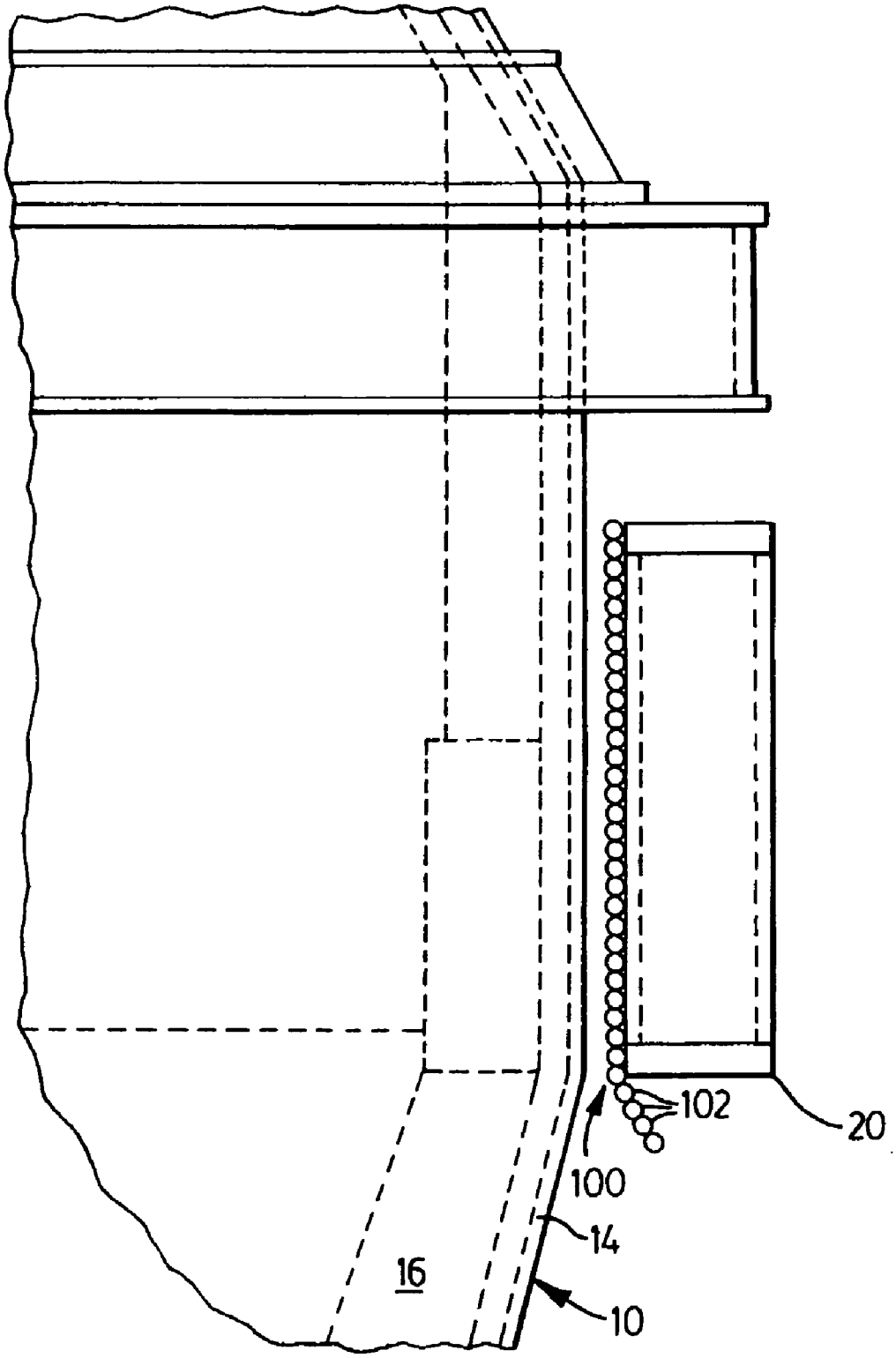
FIG. 4 is a side sectional view of the vessel and cooling assembly of FIG. 1 taken along line C—C.

Each of the panels 110, for example the panel indicated by reference 110*a* in FIGS. 3 and 4 includes a coolant inlet 140 and a coolant outlet 142. A suitable coolant fluid or gas is provided from a coolant supply tank and pump 144. The coolant supply tank 144 has an output which is coupled to the coolant inlet 140 on the cooling panel 110*a*. The coolant supply tanks 144 also have an input which is connected to the coolant outlet on the cooling panel 110*a*. Similarly, the other cooling panels 110 include coolant inlets and coolant outlet. Fresh or cooled coolant liquid or gas is pumped into the cooling panel 110*a* through the cooling inlet 140, and the coolant circulated through the cooling panel 110 is drained through the coolant outlet 142. The drained coolant may be cooled and treated for recirculation as in a closed loop system, or simply drained with the other coolant liquids applied to the refinery process. According to this embodiment, each of the cooling panels 110 operate independently of each other. In the event that one of the cooling panels 110 fails, the flow of coolant to the affected cooling panel can be selectively halted while the other cooling panels remain in operation.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A method for cooling a trunnion ring, the trunnion ring supporting a vessel in a metallurgical converter and having a surface adjacent the vessel and being in a spaced relationship from the vessel, said method comprising the steps of:

coupling one or more cooling panels to cover at least a portion of the surface of the trunnion ring adjacent the vessel;

supplying a coolant at an inlet for at least one of said cooling panels;

circulating said coolant in said cooling panel and said coolant serving to cool the trunnion ring by absorbing heat radiated from said vessel.

2. The method as claimed in claim 1, wherein said step of coupling said one or more cooling panels comprises affixing a bracket to each of said cooling panels and connecting said respective bracket to said trunnion ring, and said bracket permitting removal of said cooling panel for repair or replacement.

3. The method as claimed in claim 2, wherein said step of supplying a coolant comprises connecting a coolant supply tank and pump to the inlet of said cooling panel and to an outlet on said cooling panel.

4. The method as claimed in claim 3, wherein for said step of circulating said coolant, said cooling panel includes a plurality of conduits and said coolant is circulated through said plurality of conduits.

5. The method as claimed in claim 1, further including the step of interconnecting at least two of said cooling panels, wherein each of said cooling panels include an outlet, and said step of interconnecting comprises coupling the outlet of one of said cooling panels to the inlet of another one of said cooling panels.

6. The method as claimed in claim 5, wherein said step of coupling said one or more cooling panels comprises detachably coupling said cooling panels to said trunnion ring, so that any one of said cooling panels is removable for replacement.

7. The method as claimed in claim 5, wherein said step of coupling said one or more cooling panels comprises said cooling panel having a bracket and connecting said bracket to said trunnion ring, and said bracket being detachable for removing said cooling panel for repair.

8. The method as claimed in claim 6, wherein said step of supplying a coolant comprises providing a coolant supply tank and pump having an output and an input, and coupling said coolant supply output to the inlet of a first one of said cooling panels, and coupling said coolant supply input to the outlet of another of said cooling panels.

9. The method as claimed in claim 8, wherein for said step of circulating said coolant comprises said cooling panel having a network of conduits and said coolant being circulated by said coolant pump through said network of conduits.

* * * * *